US009629431B2

(12) United States Patent
Hoover et al.

(10) Patent No.: US 9,629,431 B2
(45) Date of Patent: Apr. 25, 2017

(54) COMPOSITE FIBER REINFORCEMENT FOR STIFFENING SHELLS

(71) Applicant: Apple Inc., Cupertino, CA (US)

(72) Inventors: Joshua A. Hoover, San Francisco, CA (US); Aaron P. Beese, Cupertino, CA (US); Ambert T. Yeung, Brisbane, CA (US)

(73) Assignee: Apple Inc., Cupertino, CA (US)

( * ) Notice: Subject to any disclaimer, the term of this patent is extended or adjusted under 35 U.S.C. 154(b) by 36 days.

(21) Appl. No.: 14/281,644

(22) Filed: May 19, 2014

(65) Prior Publication Data

US 2015/0327641 A1 Nov. 19, 2015

(51) Int. Cl.

| | |
|---|---|
| ***B65D 85/00*** | (2006.01) |
| ***A45C 11/00*** | (2006.01) |
| ***A45F 5/00*** | (2006.01) |
| ***A45C 13/36*** | (2006.01) |

(52) U.S. Cl.

CPC ..... *A45C 11/00* (2013.01); *A45C 13/36* (2013.01); *A45F 5/00* (2013.01); *A45C 2011/002* (2013.01)

(58) Field of Classification Search

CPC ... A45C 11/00; A45C 2011/002; A45C 13/36; A45F 5/00

USPC ..... 206/320; 224/191; 264/247

See application file for complete search history.

(56) References Cited

U.S. PATENT DOCUMENTS

| | | | | |
|---|---|---|---|---|
| 8,204,561 | B2 * | 6/2012 | Mongan | A45C 11/00 206/592 |
| 8,531,834 | B2 * | 9/2013 | Rayner | G06F 1/1656 277/644 |
| 8,672,126 | B2 * | 3/2014 | Rohrbach | A45C 9/00 206/320 |
| 2011/0314651 | A1 * | 12/2011 | Behar | A45C 11/00 29/428 |
| 2013/0190052 | A1 * | 7/2013 | Lundell | H04M 1/0262 455/566 |

OTHER PUBLICATIONS

Zylon Technical Information, Toyobo, Jun. 2005, pertinent pp. 1-3.*

* cited by examiner

*Primary Examiner* — Anthony Stashick
*Assistant Examiner* — James M Van Buskirk
(74) *Attorney, Agent, or Firm* — Downey Brand LLP

(57) ABSTRACT

This application relates to methods and apparatus for reinforcing fragile portions of a device case. In some embodiments, the device case can be reinforced by a reinforcing member made up of composite extrusions that are embedded within a top edge portion of the stiffening shell. The device shell can be utilized to define and maintain an overall shape of the device case. Composite fibers suitable for use in these embodiments can have high tensile strength and high tensile modulus. The device case can include a single length of embedded twisted composite fibers that extend continuously around the top edge or alternatively can include a number of discrete segments that reinforce particularly fragile portion of the top edge.

20 Claims, 9 Drawing Sheets

C-C

COMPOSITE FIBER REINFORCEMENT FOR STIFFENING SHELLS

FIELD

The described embodiments relate generally to reinforcing features for device cases. More particularly, the present embodiments relate to embedding fibers into a stiffening shell of a device case.

BACKGROUND

Materials such as polyurethane and leather can be wrapped around a stiffening shell to provide a stable shape and/or rigidity to a device case. The stiffening shell can be utilized to reinforce various portions of the device case. Unfortunately, in some cases the stiffening shell may not be robust enough to reinforce particularly fragile portions of the device case. For example, openings in the device case can be positioned particularly close to an edge of the casing. In such a configuration, a portion of the case defining the opening and bordering the edge can be particularly thin, creating what can sometimes be referred to as a thin web condition, thereby leaving the opening susceptible to damage or even breakage. Simply thickening the stiffening layer enough to achieve a robust opening can leave the device case thicker and/or taller than desired. Furthermore, moving the opening away from the edge can be unpractical as the position proximate the edge may be necessary to facilitate access to a portion of a device such as a user interface element along the lines of a button or switch.

SUMMARY

This paper describes various embodiments that relate to methods and apparatus for reinforcing at least a portion of a stiffening shell for an electronic device case.

A case for a portable electronic device is disclosed. The case for the portable electronic device includes at least the following: an injection-molded stiffening shell and a cosmetic layer encasing and conforming to a shape of the injection molded stiffening shell. The injection molded stiffening shell includes a bottom wall and side walls that cooperate to form a cavity having a shape and size in accordance with the portable electronic device. One of the side walls includes an opening adjacent to a top edge of the side wall, and a number of interwoven fibers embedded within the top edge that are configured to reinforce at least one side of the opening.

A method for forming a device case is disclosed. The method for forming the device case includes at least the following steps: co-extruding a fiber with a polymeric material to form a composite extrusion, the polymeric material of the composite extrusion encasing the fiber; interweaving the composite extrusion with at least one other composite extrusion to form a reinforcing member; insert-molding a stiffening shell to include the reinforcing member adjacent to an opening in the stiffening shell; and wrapping a protective layer over the stiffening shell. Molding material utilized to form the stiffening shell is substantially the same as the polymeric material of the composite extrusion.

An injection molded stiffening shell for an electronic device case is disclosed. The injection molded stiffening shell includes at least the following: a number of side walls and a bottom wall that cooperate to define a cavity, one of the side walls defining an opening adjacent to a top edge of the side wall; and a reinforcing member disposed within the top edge of the side wall, the reinforcing member including a number of composite fibers twisted together, the twist of the fibers causing a direction of the composite fibers to change along a length of the reinforcing member. The top edge defines at least a portion of a peripheral edge of the opening.

Other aspects and advantages of the invention will become apparent from the following detailed description taken in conjunction with the accompanying drawings which illustrate, by way of example, the principles of the described embodiments.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1A:
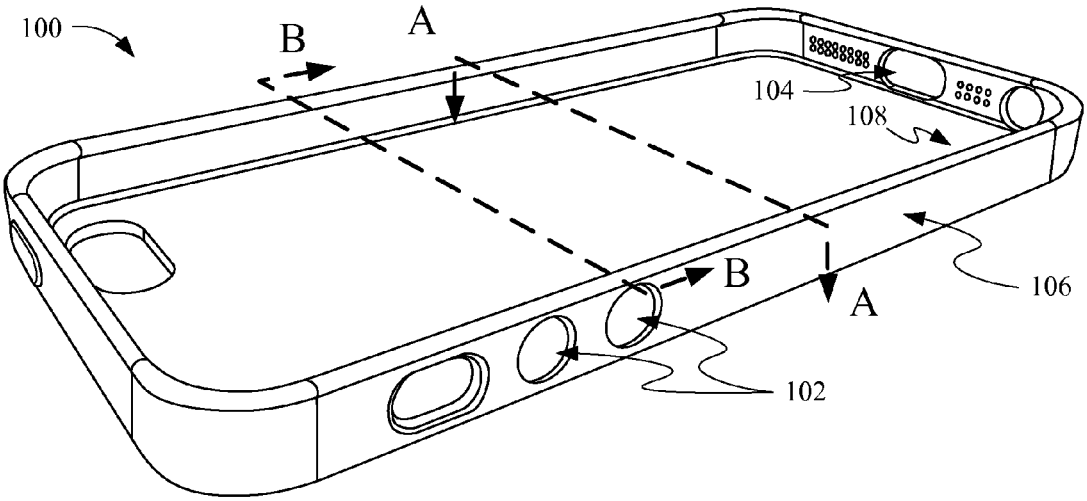
FIG. 1A shows a perspective view of an exemplary device case having a number of openings disposed through its side walls.

Representative applications of methods and apparatus according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments.

Device cases for electronic devices can have many purposes; however, a primary purpose for most cases is protection of the electronic device. As electronic devices are generally susceptible to damage, a device case that protects vulnerable portions of an electronic device without adding unnecessary bulk or inhibiting use of any device features is highly desirable. To achieve all three objectives, device cases strike a careful balance between design objectives. A device case can be designed to cover only those portions of a device that are susceptible to damage. To accomplish this, the device case may only cover rear and side portions of a device, leaving a front portion of the device exposed for unfettered access to a user interface disposed along the front portion of the device. When user interface elements, such as buttons, switches or even input/output port openings are disposed along the side portions of the device, openings sized to accommodate these user interface elements can be positioned in close proximity to an edge defining an opening accommodating the front of the device. While device cases do commonly use stiffening shells that define a shape of and reinforce various portions of the device case, these stiffening shells are typically made of a thin layer of plastic or similar material that have a thin form factor so that the shell does not add additional bulk to the device case. Unfortunately, the thin stiffening shells are not well configured to provide robust reinforcement for thin webbed portions of the device case.

One solution to this problem is to reinforce portions of the thin shell with a material that is stronger than material used to form the stiffening shell. In one embodiment, strands of composite fiber having both high tensile modulus and high tensile strength can be formed within portions of a stiffening shell or layer to strengthen at least the portions of the stiffening shell that correspond to fragile portions of the device case. When the stiffening shell is formed by an injection molding operation, the composite fiber strands can be insert-molded into the stiffening shell during formation of the stiffening shell. By positioning the composite fiber strands within portions of a mold cavity prior to the injection molding, the composite fiber strands can be appropriately positioned within the stiffening shell once the injection molding operation is complete.

Adhesion between the composite fiber strands and the stiffening shell is also particularly important. For example, if the composite fiber strands are linearly disposed within the stiffening shell, the stiffening shell may still break or crack under stress if the there is slippage between the composite fiber strands and the stiffening shell; however, by twisting the composite fiber strands together, an orientation of the strands with respect to an external force can be varied, allowing portions of the composite fibers to provide excellent resistance to slippage between the material of the shell and the composite fiber. In this way, the shell can receive full benefit from material properties of the embedded composite fibers.

Another way to enhance adhesion between the composite fibers and the shell is to co-extrude the composite fibers within material similar to the material of the shell. This creates a composite extrusion in which the composite fibers are surrounded in a layer of material similar to or the same as material used to form the shell. In some embodiments, the shell material can be a polycarbonate polymer. When the composite extrusion includes the shell material along the outside surface of the composite extrusion, then during the injection molding operation the heated injection molding material can at least partially melt the material surrounding the composite fibers so that when the injection molding material cools the injection molded material is chemically joined with an exterior portion of the composite extrusion. Because the composite extrusions can have a substantially larger diameter than the composite fibers, when the composite extrusions are twisted or interwoven together the increased diameter causes a change in orientation of the fibers to be greater than the change would otherwise be if the composite fibers were twisted together without going through the co-extrusion process. This further increases a mechanical coupling between the composite extrusions and the injection molded material. It should be noted that the composite fibers should be formed from a material that imparts high tensile strengths and modulus to the composite fibers. Composite fibers formed from materials along the lines of a Zylon® thread (a thermoset liquid crystalline polyoxazole), Kevlar® (a para-aramid synthetic fiber), Dyneema (an ultra-high molecular weight polyethylene) and Vectran® (a liquid crystal polymer along the lines of an aromatic polyester) would be well suited for use with the described embodiments. Zylon® in particular has a high tensile strength and a high tensile modulus along the lines of about 5.8 GPa and 270 GPa respectively.

Formation of the above described embodiments can be accomplished in many ways. In one embodiment, composite extrusions that have been twisted together to form a reinforcing member can be arranged into a loop defined by a channel disposed within an injection mold unit component prior to initiating an injection molding operation. In this way, the channel defines the position of the reinforcing member within a cavity of the injection mold unit. A slider or wedge can be configured to exert pressure upon walls defining the channel to secure the reinforcing member in place prior to initiating the injection molding operation.

These and other embodiments are discussed below with reference to FIGS. 1A-6; however, those skilled in the art will readily appreciate that the detailed description given herein with respect to these figures is for explanatory purposes only and should not be construed as limiting.

FIG. 1A shows an exemplary device case 100. Device case 100 is configured to cover a substantial portion of a back surface and side surfaces of an electronic device. Device case 100 can include a number of openings that serve various purposes, including for example providing access to buttons, switches and port connectors. Device case 100 can include button openings 102 and input/output (I/O) opening 104 disposed through side walls 106. Both button openings 102 and I/O opening 104 can be positioned near a top edge 108 of device case 100. When a portion of top edge 108 is made particularly thin by for example button openings 102 or I/O opening 104, a thin web condition can be created. Although openings 102 are substantially circular it should be understood that the described embodiments can be utilized with openings having almost any shape or size. Even when device case 100 includes an internal stiffening element, the internal stiffening element or shell may not be robust enough to prevent tearing, ripping or cracking of top edge 108 where a thin web condition exists.

Figure 1B:
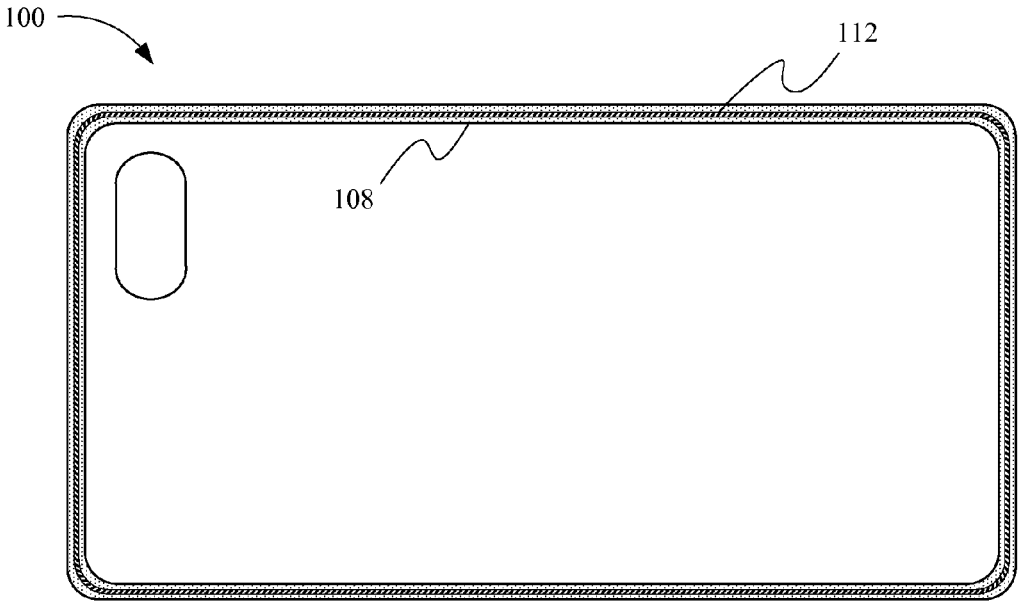
FIGS. 1B-1D show a number of configurations that can be utilized to reinforce fragile portions of a device case.
Figure 1C:
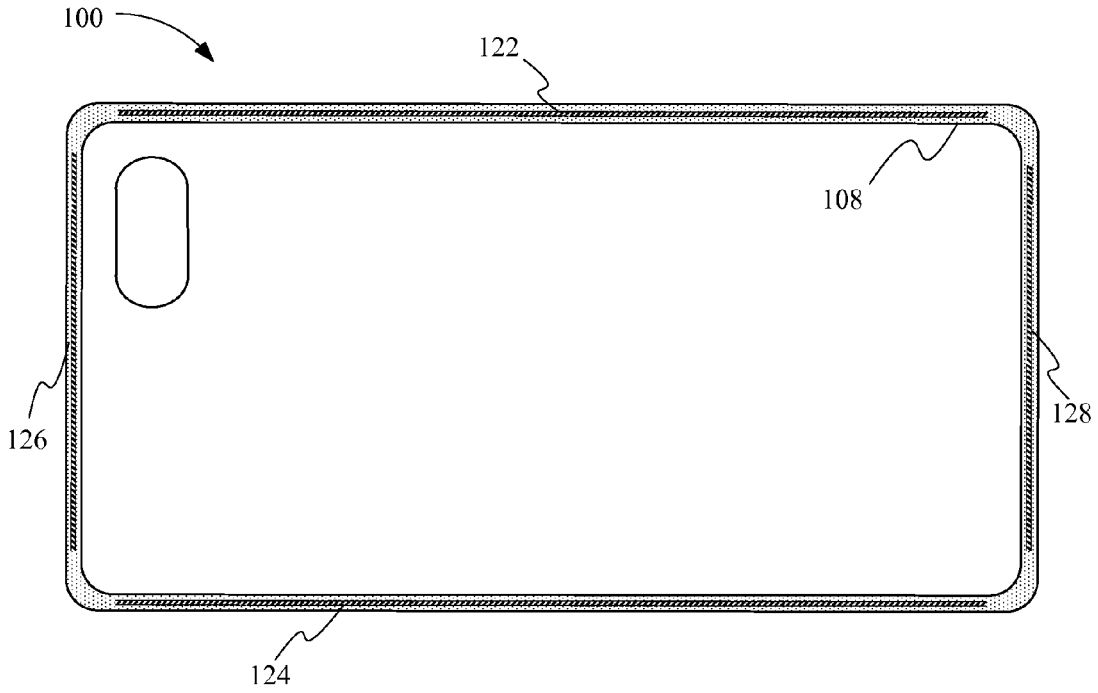
Figure 1D:
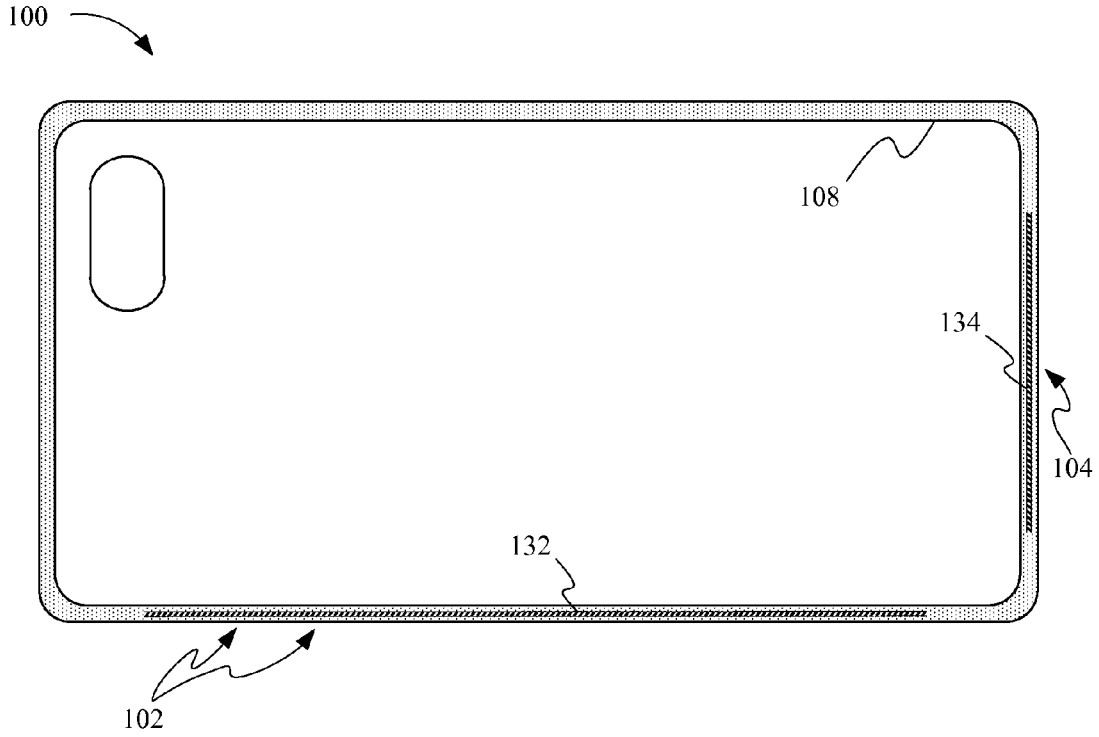
Figure 1E:
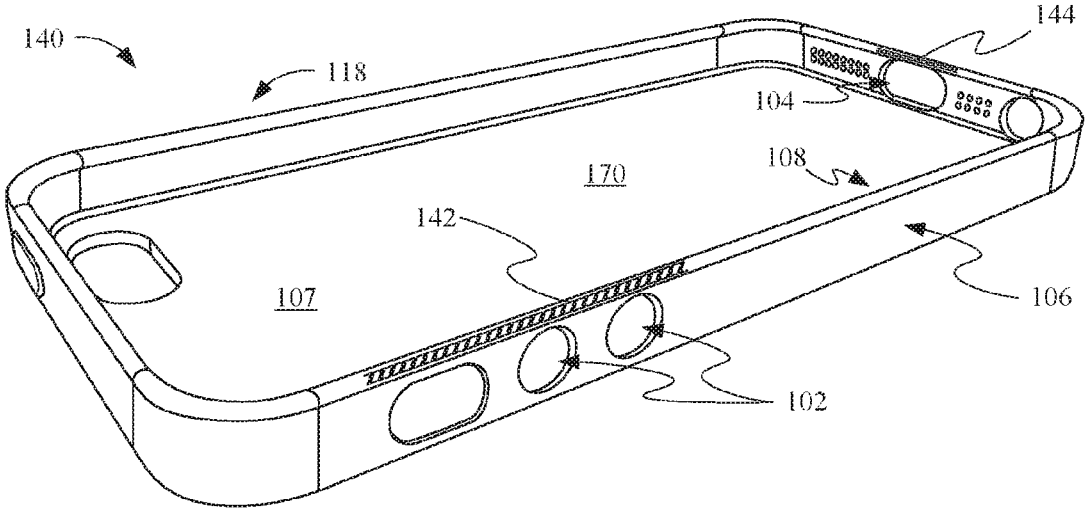
FIG. 1E shows a perspective view of a stiffening shell for a device case.

FIGS. 1B-1D show top cross-sectional views of device case 100 in accordance with section line A-A using reinforcing members in various configurations to reinforce top edge 108 of device case 100. FIG. 1B depicts device case 100 and shows how reinforcing member 112 can be embedded continuously within top edge 108, thereby reinforcing substantially all of top edge 108. In another embodiment, FIG. 1C shows how corner regions of device case 100 can remain free of a reinforcing member so that a flexibility of top edge 108 of device case 100 is not negatively impacted. Since each side of top edge 108 is reinforced by one of reinforcing members 122, 124, 126 and 128, a feel of each edge can retains a similar look and feel, while unreinforced corner regions allow side walls 106 to flex for easier insertion and extraction of a device. Finally device case 100 depicted in FIG. 1D, which depicts reinforcing members 132 and 134 being embedded only with side walls 106 that include button openings 102 and I/O opening 104 respectively. FIG. 1A depicts how these openings are disposed particularly close to top edge 108 of device case 100. This design allows an amount of the reinforcing members to be minimized. FIG. 1E shows a perspective view of stiffening shell 140 of device case 100. Stiffening shell can be formed of a polymeric material and provides stiffness and shape to device case 100. In some embodiments, the stiffening shell 140 includes side walls 106 and a bottom wall 107 that define a cavity 170. In this depiction positions of reinforcing members 142 and 144 within the device case are shown. It should be understood reinforcing members 142 and 144 are visible when stiffening shell 140 is transparent, but in cases where stiffening shell 140 is formed of visually opaque material, reinforcing members 142 and 144 would be hidden. Reinforcing members 142 and 144 are positioned only above openings in side walls 106 of stiffening shell 140. This configuration provides reinforcement above button openings 102 and I/O opening 104. FIG. 1E shows the stiffening shell 140 includes a lip 118 integrally formed with the side walls 106 that defines a front opening in the injection-molded stiffening shell 140 and opposes removal of the portable electronic device from the cavity 170, by engaging a peripheral portion of the electronic device when the electronic device is disposed within the cavity 170. A plurality of interwoven fibers can be embedded throughout the lip 118 of the stiffening shell 140. In some embodiments, the plurality of interwoven fibers are only embedded within a portion of the lip 118 that is integrally formed with the side wall 106 that defines the button opening 102.

Figure 1F:
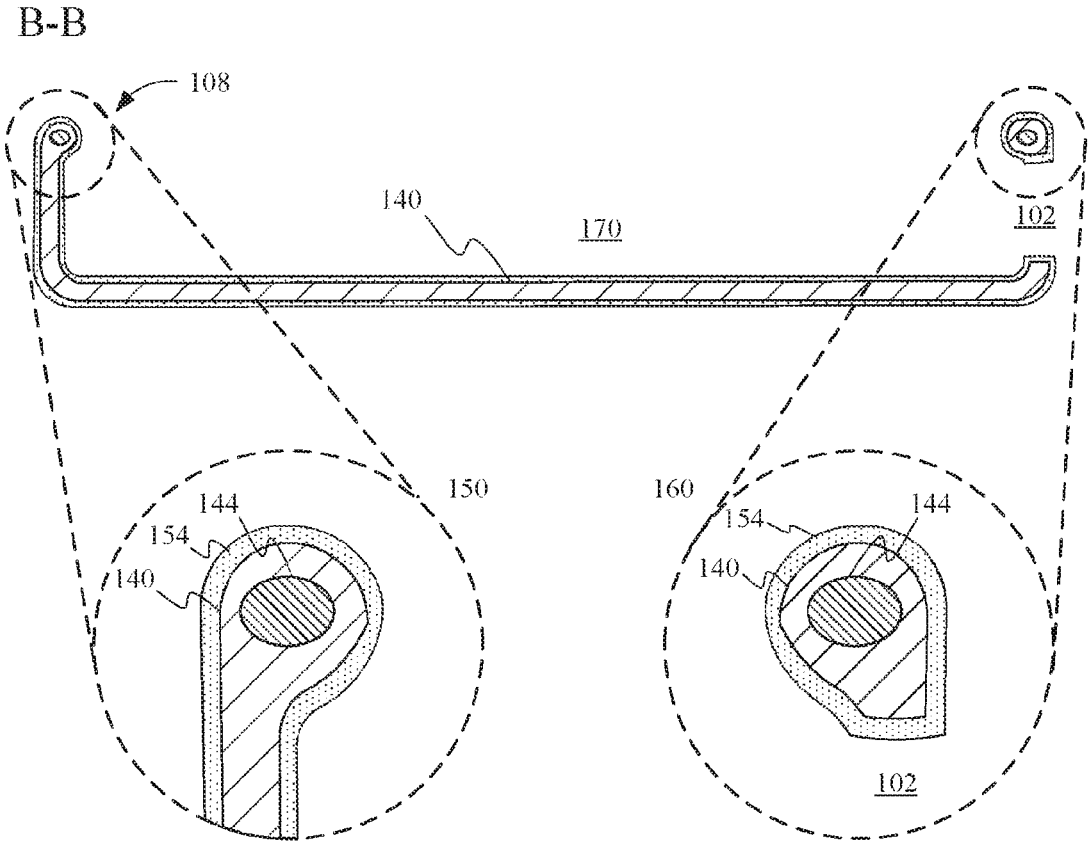
FIG. 1F shows a cross-sectional view of a device case and a position of a number of fibers within a stiffening shell of the device case.

FIG. 1F shows a cross-sectional view of device case 100 in accordance with Section Line B-B of FIG. 1A. FIG. 1F also shows enlarged views 150 and 160 of top edge 108 of device case 100. Enlarged view 150 shows how stiffening shell 140 can be embedded within an outside protective layer 154. Outside protective layer 154 can be formed from any of a number of materials including for example leather, polyurethane or plastic. As depicted, a reinforcing member 144 formed from twisted composite extrusions can be embedded within stiffening shell 140 to further increase a strength of top edge portion 108. Enlarged view 160 shows how outside protective layer 154 can be wrapped around a thin web portion of top edge 108. In this way, opening 102 of device case 100 can be reinforced so that the portion of top edge 108 depicted in enlarged view 160 does not snap under pressure or fatigue after a certain amount of use. While only two fibers are depicted reinforcing top edge portion 108, it should be understood that any number of fibers can be utilized to reinforce certain portions of device case 100.

Figure 2A:
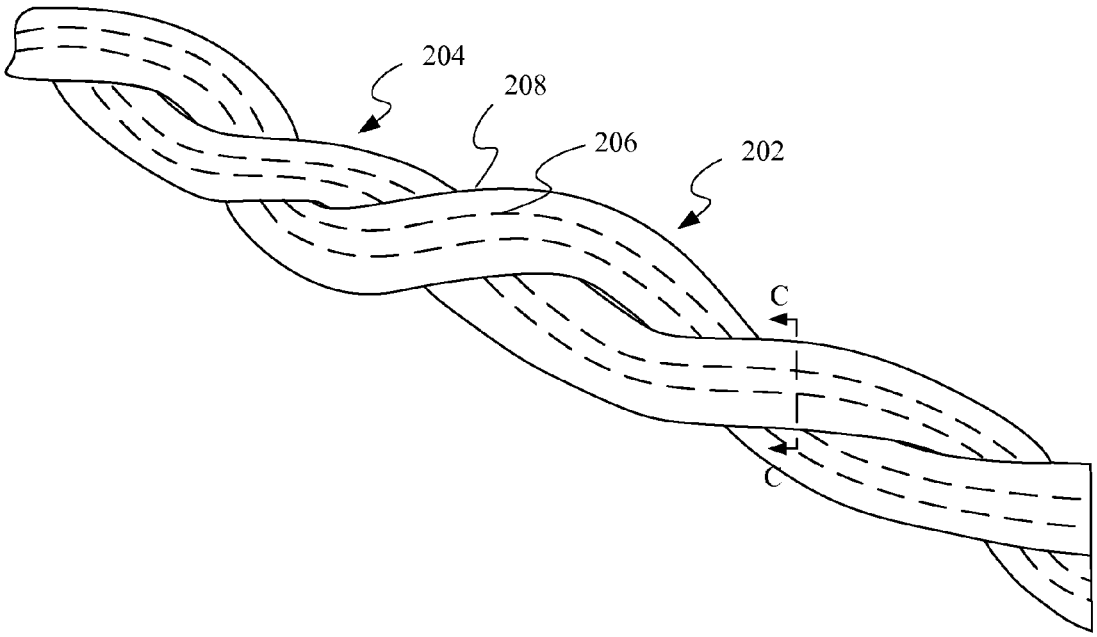
FIG. 2A shows a perspective view of a reinforcing member made from two twisted fibers.

FIG. 2A shows a number of composite extrusions twisted or interwoven together. By twisting or interweaving composite extrusions 202 and 204 together an orientation of composite fibers within the composite extrusions with respect to the stiffening shell can be continuously variable. In this way, at least a portion of the fibers can be oriented in a direction for providing a maximum amount of resistance to a particular externally applied force. Dashed portions of composite extrusions 202 and 204, depict a position of fibers 206 within composite extrusions 202 and 204. FIG. 2A also depicts how twisting of composite extrusions 202 and 204 result in fibers 206 from composite extrusion 202 being interwoven with fibers 206 from composite extrusion 204. External layers 208 of composite extrusions 202 and 204 can be formed from a material such as a polycarbonate polymer and prevents fibers 206 from coming into direct contact with one another. The composite extrusions 202 and 204 can be twisted together in any number of ways. For example, in some cases the composite extrusions can be wound together around a shaft to achieve a desired weave while in other embodiments the composite extrusions can be twisted around themselves as depicted in FIG. 2A.

Figure 2B:
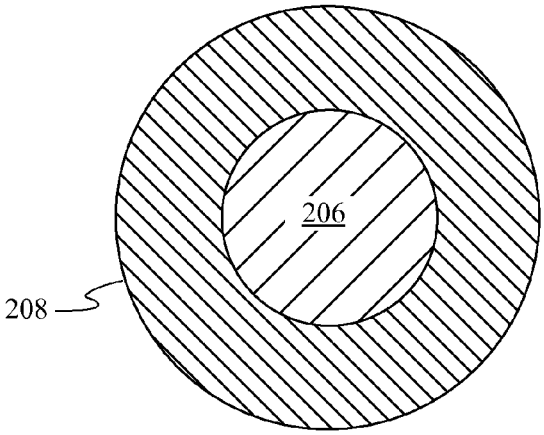
FIG. 2B shows a cross-sectional view of a coated fiber having a core enclosed by a polymeric exterior layer.

FIG. 2B shows a cross-section of composite extrusion 204 in accordance with section line C-C. In some embodiments, composite extrusion 204 can have the same configuration as composite extrusion 202, while in other embodiments composite extrusions 202 and 204 can be have different dimensions and in some cases be formed from different materials. As discussed above, composite extrusion 204 can include fibers 206 enclosed by external layer 208. Composite extrusion 204 can be formed in this configuration by way of a co-extrusion process. During the co-extrusion process material for forming fibers 206 and external layer 208 can be processed by separate extruders then pressed through a single die head to form the depicted composite extrusion 204. In some embodiments, fibers 206 can have a diameter of about 0.3 mm. Fibers 206 can be formed from materials along the lines of Zylon® (a thermoset liquid crystalline polyoxazole), Kevlar® (a para-aramid synthetic fiber), Dyneema (an ultra-high molecular weight polyethylene) and Vectran® (a liquid crystal polymer along the lines of an aromatic polyester). In some embodiments, external layer 204 can be formed from a polycarbonate polymer. In addition to promoting adhesion between the fibers and the stiffening shell, external layer 204 can also be operative to establish a minimum interval between the fibers 206 in adjacent composite extrusions. For example, a minimum distance between the fibers can be on the order of about two times a thickness of the external layer.

Figure 3:
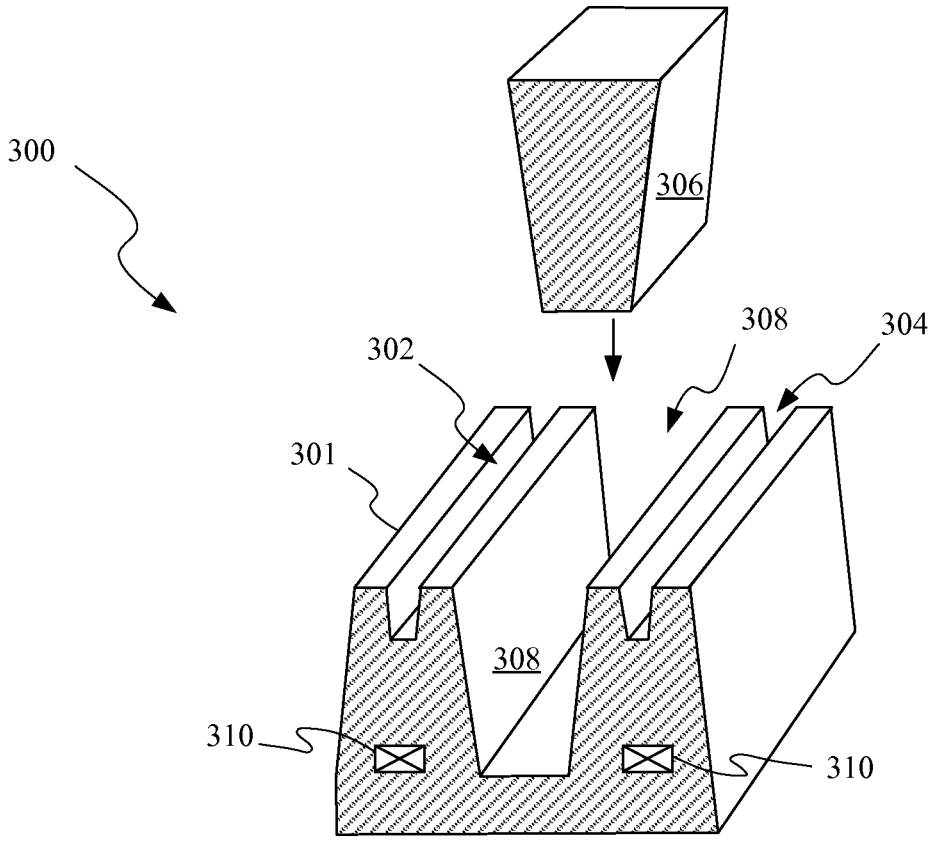
FIG. 3 shows a mold unit component that secures fibers in place during an injection molding operation.

FIG. 3 depicts a cross-sectional view of a portion of mold unit 300 that secures fibers in place during an injection molding operation. Mold unit 300 includes mold unit component 301 that defines channels 302 and 304 having a size and shape in accordance with a reinforcing member. In some embodiments, channels 302 and 304 can have a channel width slightly smaller than a width of the reinforcing member such that an interference fit is achieved between the reinforcing member and channels 302 and 304. In some embodiments, the reinforcing member can wrap continuously through channels 302 and 304. Subsequent to positioning of the reinforcing member within channels 302 and 304, cavity side wedge 306 can engage channel 308. By engaging channel 308 of body portion 301 with cavity side wedge 306, force can be exerted against channels 302 and 304, allowing the reinforcing member disposed within channels 302 and 304 to be further compressed. Cavity side wedge 306 can also be operative to prevent molding material from entering channel 308 during an injection molding operation. In some embodiments, strain sensors 310 can be embedded within mold unit component 301. Strain sensors 310 can be configured to provide feedback to an apparatus exerting force upon cavity side wedge 306. Based upon the amount of strain measured by strain sensors 310, an amount of force exerted upon cavity side wedge 306 can be adjusted so that mold unit component 301 receives a desired amount of strain. In this way, an amount of force exerted across an interface between side walls of channels 302 and 304 and the reinforcement member disposed within the channels can be accurately regulated.

Figure 4:
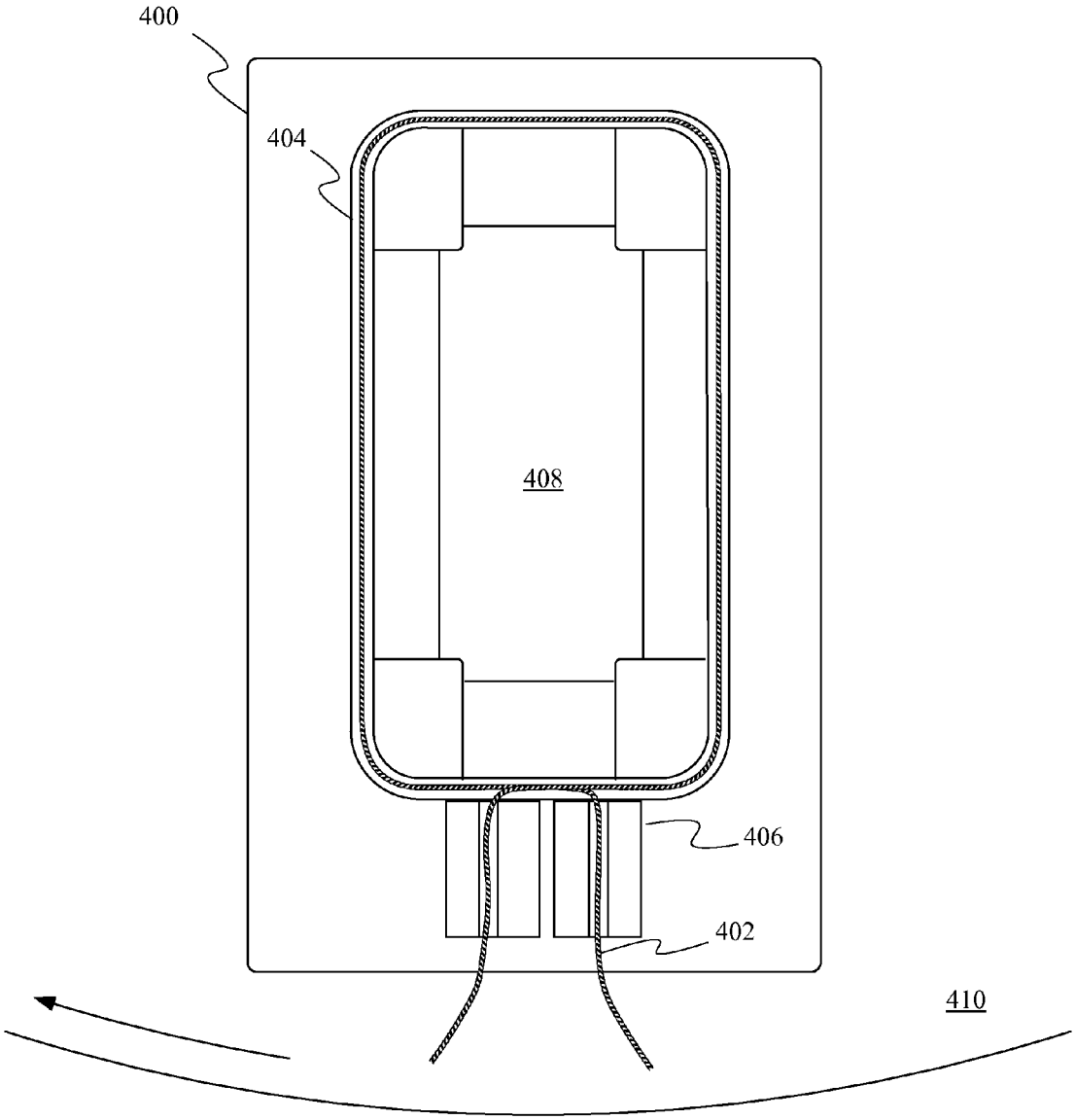
FIG. 4 shows a top view of a mold unit component disposed upon a rotary device.

FIG. 4 shows a top view of mold unit component 400 for securing a continuous length of reinforcing member 402 in place during an injection molding operation. Mold unit component 400 includes channel 404 that defines a geometry of at least a portion of a top edge of a stiffening shell or layer during formation of the stiffening shell during an injection molding operation. In some embodiments, reinforcing member 402 can include a number of lengths of fiber twisted or braided together. By looping reinforcing member 402 through channel 404 and then placing tension on both ends of reinforcing member 402, the loop formed by reinforcing member 402 can be tightened so that the loop conforms with a curvature defined by a geometry of channel 404. Securing blocks 406 can be utilized to maintain tension upon reinforcing member 402 by trapping end portions of reinforcing member 402 within securing blocks 406. In some cases, securing blocks 406 can include clasps or gripping mechanisms that can secure the ends of reinforcing member 402. It should be noted that subsequent to an injection molding operation, excess portions of reinforcing member 402, falling outside of channel 404 can be cut away to prevent the excess from protruding from a completed stiffening shell. Mold unit component 400 can also include a depression 408 that can receive a slider that defines an interior cavity for forming a stiffening shell. Similar to the depiction show in FIG. 3, when the slider is received it can plastically deform a portion of mold unit component 400 that defines channel 404, thereby causing channel 404 to narrow so that reinforcing member 402 remains firmly within channel 404 during an injection molding operation.

FIG. 4 also depicts rotary device 410, which supports mold unit component 400. Rotary device 410 can be part of a vertical molding machine assembly and can support a number of mold unit components 400. In some embodiments, rotary device 410 can be circular and can have an axis of rotation substantially parallel to the ground. This configuration allows rotary device 410 to translate mold unit components mounted to it to be translated both vertically and horizontally during rotation. Subsequent to reinforcing member 402 being placed within channel 404, rotary device 410 can be rotated causing mold unit component 400 to be translated to a position where the mold unit component can be mated with other mold unit components. Subsequent to mold unit component 400 being mated with other mold unit components, an injection molding operation can be initiated. This vertical molding machine assembly allows at least one of mold unit components 400 to be loaded with reinforcing member 402 while at least one other mold unit component 400 receives injection-molding material during an injection molding operation. In this way, a worker or automated machinery can stay busy loading fibers 402 until the injection molding operation is complete, at which point the completed shell can be removed from one of mold unit components 400 for further processing while the recently loaded reinforcing member 402 can undergo an injection molding operation. Further processing can include covering the completed stiffening shell with protective layer 142 (depicted in FIG. 1C).

Figure 5A:
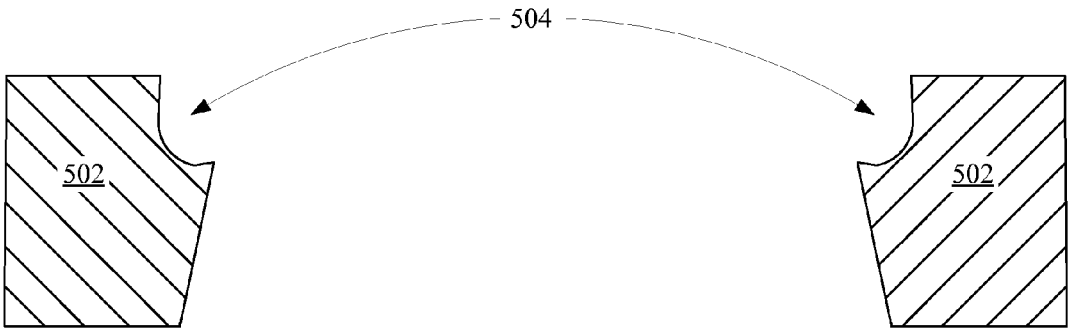
FIGS. 5A-5D show cross-sectional views of a number of mold unit components for forming a device case by an injection molding operation.
Figure 5B:
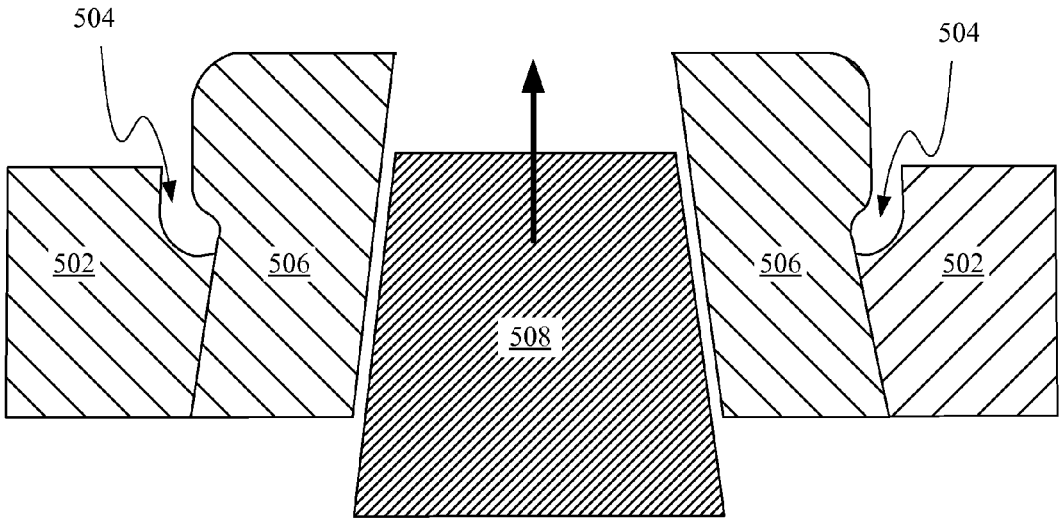
Figure 5C:
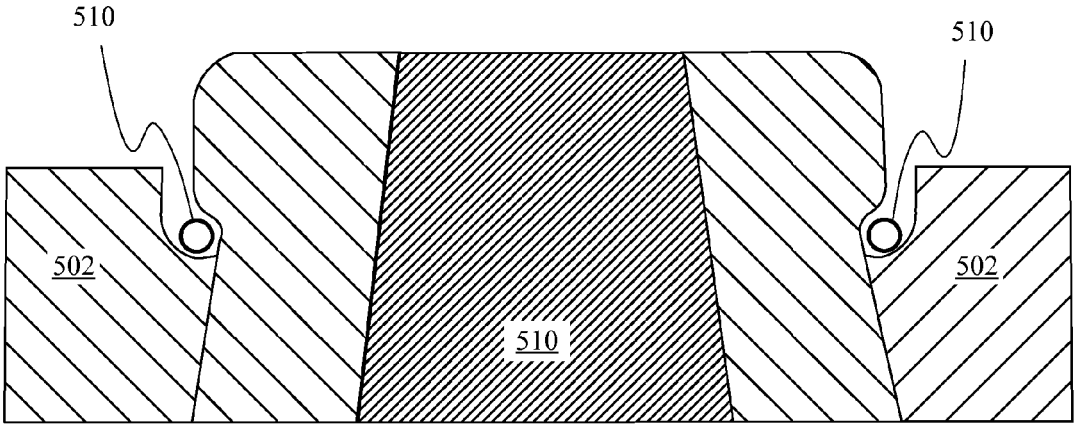
Figure 5D:
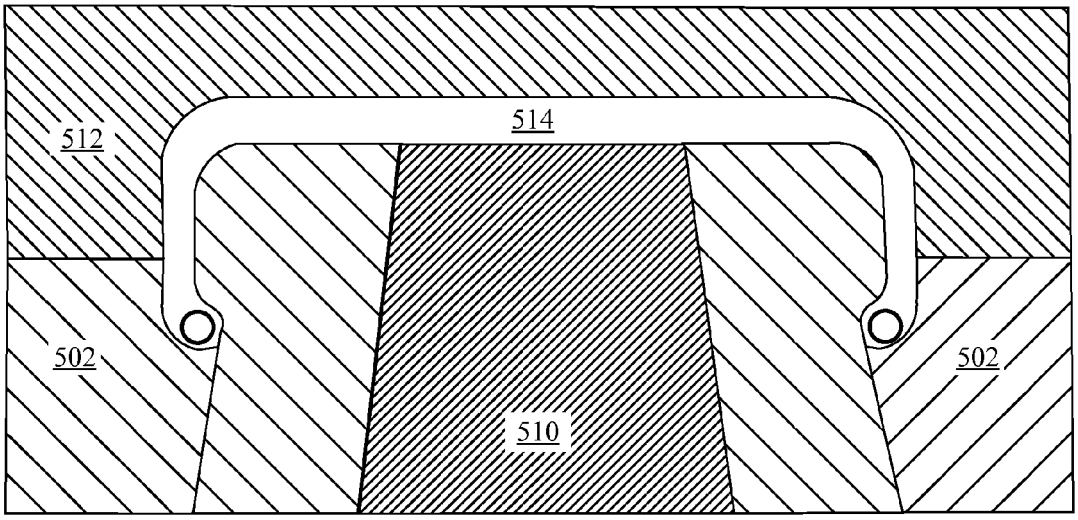

FIGS. 5A-5D show cross-sectional views of mold unit components for forming a device case. FIG. 5A depicts a partial cross-sectional view of a mold unit component 502 that defines a portion of channel 504. In FIG. 5B sliders 506 are positioned adjacent to mold unit component 502 to fully define a shape of channel 504. Also depicted in FIG. 5B is core 508 which engages and can be mechanically locked with sliders 506. In this way, core 508 and mold unit component 502 secures sliders 506 against mold unit 502. In FIG. 5C a reinforcing member 510 or members 510 can be placed within channel 504, as described in FIG. 4. Finally, in FIG. 5D mold unit component 512 engages mold unit component 502 to define an internal volume 514. Internal volume 514 is a cavity defined by mold unit components 502 and 512 in cooperation with sliders 506 and core 508, which receives injection-molding material during an injection molding operation. During the injection-molding operation, the injected material can at least partially melt and mix with material forming the external layer of reinforcing member 510, thereby causing chemical bonds to form between the molding material and the external layer of reinforcing member 510. In this way, fibers associated with reinforcing member 510 can maintain a twisted orientation while becoming firmly integrated into the resulting stiffening shell. It should be noted that while runners and pressing mechanisms have been omitted from these drawings it should be understood that the mold unit components would include standard supporting features well known to a person having ordinary skill in the art.

Figure 6:
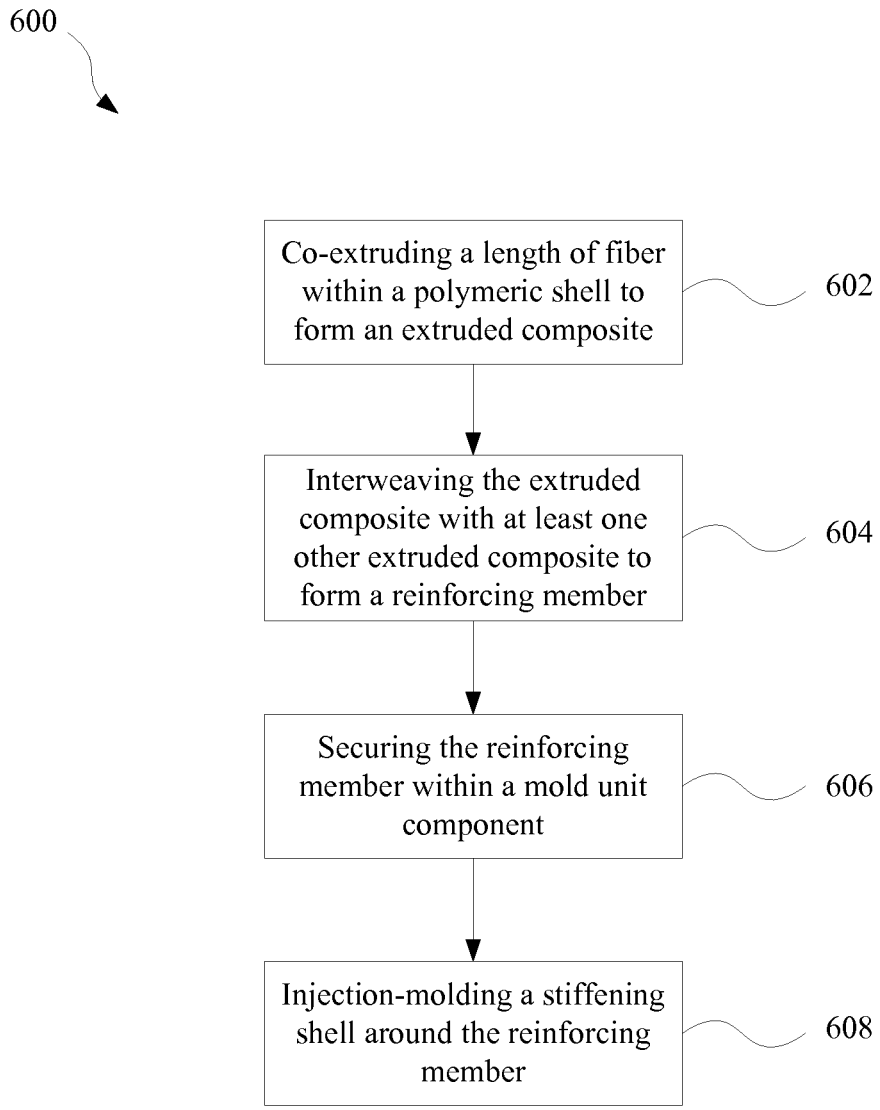
FIG. 6 shows a flow chart representing a method for forming a device case.

FIG. 6 depicts a flow chart representing a method 600 for producing a device case. In a first step 602, a composite extrusion is formed by co-extruding a length of fiber within an amount of polymeric material. The co-extrusion operation can be implemented by two separate extruders. When the material is extruded from the separate extruders it is then pressed through a single die head to form the composite extrusion. In step 604, the composite extrusion is interwoven with at least one other composite extrusion so that the composite extrusions cooperate to form a reinforcing member in which an orientation of the fibers within the composite extrusion changes along a length of the reinforcing member. In step 606 the reinforcing member is secured within a channel defined by a mold unit component. In some embodiments, a slider engages the mold unit component in a way that causes a portion of the mold unit component to deform and narrow a width of the channel. In this way, the reinforcing member can be compressed within the channel, thereby preventing movement of the reinforcing member during an injection molding operation. In some embodiments, the channel of the mold unit cavity can be slightly narrower than a width of the reinforcing member, thereby creating an interference fit between the channel and the reinforcing member. In some instances the interference fit can be sufficient to hold the reinforcing member in place during the injection-molding operation. In step 608, molding material is injected around the reinforcing member, causing the reinforcing member to be embedded within a stiffening shell. Subsequent to formation of the stiffening shell, the stiffening shell can be covered in a protective and/or cosmetic layer that provides an amount of cushioning and a cosmetically appealing exterior surface to the device case. It should be noted that the protective layer can also be operative to prevent scratching of an electronic device as the electronic device is inserted and removed from the device case.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A case comprising:

a shell comprising a bottom wall and side walls that cooperate to form a cavity having a shape and size in accordance with a portable electronic device, wherein one of the side walls includes an opening that extends between the cavity and an exterior surface of the shell; and a reinforcing member embedded within a portion of the side wall including the opening, wherein the portion is less than an entire length associated with the side wall so as to reinforce the opening.

2. The case as recited in claim 1, further comprising an outer layer formed over the shell.

3. The case as recited in claim 1, wherein the shell further comprises:

a lip integrally formed with the side walls that further defines the cavity and prevents removal of the portable electronic device from the cavity.

4. The case as recited in claim 1, wherein the reinforcing member is only embedded within a top edge of the side wall that includes the opening.

5. The case as recited in claim 3, wherein the reinforcing member is embedded within a portion of the lip that is integrally formed with the side walls.

6. The case as recited in claim 1, wherein the reinforcing member is comprised of a plurality of interwoven fibers.

7. The case as recited in claim 6, wherein each interwoven fiber of the plurality of interwoven fibers is separated by an amount of molding material.

8. A method for forming a case for an electronic device, the method comprising:

interweaving a composite extrusion together with at least one other composite extrusion to form a reinforcing member; and insert-molding a shell to include the reinforcing member such that the reinforcing member is embedded within a portion of a side wall of the shell that includes an opening, wherein the portion is less than an entire length associated with the side wall.

9. The method as recited in claim 8, further comprising:

placing the reinforcing member within a channel of a mold unit component that defines a top edge of the shell; and engaging the mold unit component with a slider component that plastically deforms the mold unit component and narrows a width of the channel so that the reinforcing member is compressed within the channel.

10. The method as recited in claim 9, wherein the mold unit component is a first mold unit component and the reinforcing member is a first reinforcing member, the method further comprising:

shifting a position of the first mold unit component so that a second reinforcing member can be placed within a second mold unit component while the shell is insert-molded around the first reinforcing member disposed within the first mold unit component.

11. The method as recited in claim 10, wherein the composite extrusion is formed by co-extruding a fiber with a polymeric material such that the polymeric material encases the fiber.

12. The method as recited in claim 8, further comprising: wrapping a protective layer over the shell.

13. The method as recited in claim 9, wherein engaging the mold unit component with the slider component comprises engaging the slider component with an amount of force that is in accordance with an amount of strain measured by strain sensors embedded within the mold unit component.

14. The method as recited in claim 11, wherein the shell is comprised of molding material that is substantially the same as the polymeric material.

15. A molded shell for an electronic device, the molded shell comprising:

side walls that define a cavity, the side walls comprising a wall having a reinforcing member embedded within a top edge of the wall, wherein the wall includes a portion adjacent to the top edge and having an opening that extends between the cavity and an external surface of the wall, and wherein the portion is characterized as having a reduced thickness relative to the top edge.

16. The molded shell as recited in claim 15, further comprising:

a lip integrally formed with the side walls that further define the cavity and are configured to oppose removal of the electronic device from the cavity.

17. The molded shell as recited in claim 15, wherein the reinforcing member includes a plurality of interwoven fibers.

18. The molded shell as recited in claim 17, wherein one of the plurality of interwoven fibers has a diameter of about 0.3 mm.

19. The molded shell as recited in claim 17, wherein one of the plurality of interwoven fibers has a tensile strength of greater than 5 GPa.

20. The molded shell as recited in claim 15, wherein the wall is comprised of transparent or opaque material.

* * * * *